US012416056B2

(12) United States Patent
Perlade et al.

(10) Patent No.: US 12,416,056 B2
(45) Date of Patent: Sep. 16, 2025

(54) HIGH TOUGHNESS HOT ROLLED AND ANNEALED STEEL SHEET AND METHOD OF MANUFACTURING THE SAME

(71) Applicant: ArcelorMittal, Luxembourg (LU)

(72) Inventors: Astrid Perlade, Le Ban-Saint-Martin (FR); Kangying Zhu, Metz (FR); Coralie Jung, Metz (FR); Frédéric Kegel, Yutz (FR)

(73) Assignee: ArcelorMittal, Luxembourg (LU)

( * ) Notice: Subject to any disclaimer, the term of this patent is extended or adjusted under 35 U.S.C. 154(b) by 482 days.

(21) Appl. No.: 17/784,759

(22) PCT Filed: Dec. 16, 2020

(86) PCT No.: PCT/IB2020/062004
§ 371 (c)(1),
(2) Date: Jun. 13, 2022

(87) PCT Pub. No.: WO2021/124132
PCT Pub. Date: Jun. 24, 2021

(65) Prior Publication Data

US 2023/0002842 A1 Jan. 5, 2023

(30) Foreign Application Priority Data

Dec. 19, 2019 (WO) ..... PCT/IB2019/061092

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C21D 8/0226* (2013.01); *C21D 8/0236* (2013.01); *C21D 8/0273* (2013.01); *C21D 9/46* (2013.01); *C22C 38/001* (2013.01); *C22C 38/002* (2013.01); *C22C 38/02* (2013.01); *C22C 38/04* (2013.01); *C21D 2211/005* (2013.01)

(58) Field of Classification Search
CPC .. C21D 8/0226; C21D 8/0236; C21D 8/0273; C21D 9/46; C21D 2211/005; C21D 6/005; C21D 8/0263; C21D 1/26; C22C 38/001; C22C 38/002; C22C 38/02; C22C 38/04; C22C 38/06; C22C 38/12; C22C 38/14; C22C 38/22; C22C 38/26; C22C 38/28; C22C 38/32; C22C 38/34; C22C 38/38
See application file for complete search history.

(56) References Cited

U.S. PATENT DOCUMENTS

| | | | | |
|---|---|---|---|---|
| 2005/0199322 | A1 | 9/2005 | Nakamura et al. | |
| 2009/0107588 | A1 | 4/2009 | Sebastien et al. | |
| 2013/0220490 | A1* | 8/2013 | Hayashi | C22C 38/26 148/330 |
| 2013/0292009 | A1* | 11/2013 | Hayashi | C22C 38/04 148/531 |
| 2013/0319582 | A1 | 12/2013 | Yokoi et al. | |
| 2015/0329950 | A1 | 11/2015 | Azuma et al. | |
| 2016/0326608 | A1* | 11/2016 | Hayashi | C21D 9/48 |
| 2018/0030564 | A1 | 2/2018 | Hasegawa et al. | |
| 2018/0135146 | A1* | 5/2018 | Takata | C21D 6/005 |
| 2018/0371566 | A1 | 12/2018 | Gospodinova et al. | |
| 2019/0040489 | A1* | 2/2019 | Hasegawa | C22C 38/04 |
| 2019/0106760 | A1* | 4/2019 | Yamashita | C21D 8/0426 |
| 2019/0226061 | A1* | 7/2019 | Sano | C22C 38/58 |
| 2019/0276907 | A1* | 9/2019 | Yamashita | C22C 38/16 |
| 2019/0309396 | A1 | 10/2019 | Kizu et al. | |
| 2020/0370141 | A1* | 11/2020 | Zhu | C22C 38/18 |
| 2021/0025019 | A1* | 1/2021 | Hirashima | C21D 8/0263 |
| 2021/0207234 | A1 | 7/2021 | Takashima et al. | |
| 2023/0021370 | A1* | 1/2023 | Kohtake | C22C 38/60 |
| 2023/0416859 | A1* | 12/2023 | Hiroshima | C22C 38/02 |
| 2024/0307992 | A1* | 9/2024 | Yoshinaga | C22C 38/00 |

FOREIGN PATENT DOCUMENTS

| | | | |
|---|---|---|---|
| CN | 108546812 | B | 11/2019 |
| EP | 2631307 | A1 | 8/2013 |
| EP | 2698440 | A1 | 2/2014 |
| EP | 2752500 | A1 | 7/2014 |
| EP | 3112488 | A1 | 1/2017 |
| EP | 3550047 | A1 | 10/2019 |
| JP | 2005290547 | A | 10/2005 |
| JP | 2017115191 | A | 6/2017 |

(Continued)

OTHER PUBLICATIONS

Search Report of PCT/IB2020/062004 dated Jan. 2, 2021.
Written Opinion of PCT/IB2020/062004.
Search Report of PCT/IB2019/062111 dated Feb. 17, 2021.
Written Opinion of PCT/IB2020/062111.
Search Report of PCT/IB2019/062011 dated Sep. 2, 2021.
Written Opinion of PCT/IB2020/062011.

(Continued)

*Primary Examiner* — Jenny R Wu
(74) *Attorney, Agent, or Firm* — Davidson Kappel LLC

(57) ABSTRACT

A hot rolled and annealed steel sheet having a composition including, by weight percent: C: 0.1-0.25%, Mn: 3.00-5.00%, Si: 0.80-1.60%, B: 0.0003-0.004%, S≤0.010%, P≤0.020%, N≤0.008% the remainder of the composition being iron and unavoidable impurities resulting from the smelting, and having a microstructure consisting of, in surface fraction: more than 20% of recrystallized ferrite, the balance being non-recrystallized ferrite, more than 15% of the recrystallized ferrite having grain size larger than 5 μm and a density of carbides at grain boundary of recrystallized ferrite less than 5 carbides per 10 μm of grain boundary length.

19 Claims, No Drawings

(56) References Cited

FOREIGN PATENT DOCUMENTS

| | | | |
|---|---|---|---|
| WO | WO2007101921 | | 9/2007 |
| WO | WO 2016001703 | A1 | 1/2016 |
| WO | WO2016113788 | | 7/2016 |
| WO | WO 2016/187576 | A1 | 11/2016 |
| WO | WO2017179372 | A1 | 10/2017 |
| WO | WO 2018/055425 | A1 | 3/2018 |
| WO | WO 2018/162937 | | 9/2018 |
| WO | WO 2018220430 | A1 | 12/2018 |
| WO | WO2018220598 | A1 | 12/2018 |
| WO | WO2019/111029 | A1 | 6/2019 |
| WO | WO 2019/123240 | A2 | 6/2019 |
| WO | WO 2019/123245 | A1 | 6/2019 |
| WO | WO2019122963 | A1 | 6/2019 |
| WO | WO2019122964 | A1 | 6/2019 |
| WO | WO 2021/124132 | A1 | 6/2021 |
| WO | WO 2021/124199 | A1 | 6/2021 |
| WO | WO 2021/124203 | A1 | 6/2021 |
| WO | WO2021124136 | A1 | 6/2021 |

OTHER PUBLICATIONS

Search Report of PCT/IB2020/062116 dated Feb. 22, 2021.
Written Opinion of PCT/IB2020/062116.
Cooman De B C et al, "Quench and Partitioning Steel: A New AHSS Concept for Automotive Anti-Intrusion Applications", Steel Research International, Verlag Stahleisen GMBH., Dusseldorf, DE, (Sep. 1, 2006), vol. 77, No. 9/10, ISSN 1611-3683, pp. 634-640.

* cited by examiner

HIGH TOUGHNESS HOT ROLLED AND ANNEALED STEEL SHEET AND METHOD OF MANUFACTURING THE SAME

The present invention relates to a high strength steel sheet having high toughness and low hardness and to a method to obtain such steel sheet.

BACKGROUND

To manufacture various items such as parts of body structural members and body panels for automotive vehicles, it is known to use sheets made of DP (Dual Phase) steels or TRIP (Transformation Induced Plasticity) steels.

One of the major challenges in the automotive industry is to decrease the weight of vehicles in order to improve their fuel efficiency in view of global environmental conservation, without neglecting safety requirements. To meet these requirements, new high strength steels are continuously developed by the steelmaking industry, to have sheets with improved yield and tensile strengths, and good ductility and formability.

SUMMARY OF THE INVENTION

One development made to improve mechanical properties is to increase the content of manganese in steels. The presence of manganese helps to increase ductility of steels thanks to the stabilization of austenite. But these steels present weaknesses of brittleness. To overcome this problem, elements such as boron are added. These boron-added chemistries are very tough at the hot-rolled stage but the hot band is too hard to be further processed. The most efficient way to soften the hot band is batch annealing, but this leads to a loss of toughness.

For example, the publication US20050199322 discloses a high carbon hot-rolled steel sheet having excellent ductility and stretch-flange formability, the hot rolled steel sheet being annealed in order to reduce hardness of the steel sheet.

There is therefore an unsolved problem in the prior art to obtain a hot rolled steel sheet having high toughness and low hardness, compatible with a further process.

It is an object of the present invention to solve the above-mentioned problem and to provide a steel sheet having a combination of hardness level lower than 300 HV and high toughness with Charpy impact energy at 20° C. higher than 0.40 J/mm$^2$.

The present invention provides a hot rolled and annealed steel sheet, made of a steel having a composition comprising, by weight percent:

C: 0.1-0.25%
Mn: 3.00-5.00%
Si: 0.80-1.60%
B: 0.0003-0.004%
S≤0.010%
P≤0.020%
N≤0.008% and comprising optionally one or more of the following elements, in weight percentage:

Ti≤0.04%
Nb≤0.05%
Mo≤0.3%
Al≤0.90%
Cr≤0.80% the remainder of the composition being iron and unavoidable impurities resulting from the smelting, said steel sheet having a microstructure comprising, in surface fraction, 20% or more of recrystallized ferrite
the balance being non-recrystallized ferrite,
15% or more of said recrystallized ferrite having grain size larger than 5 μm and a density of carbides at grain boundary of recrystallized ferrite less than or equal to 5 carbides per 10 μm of grain boundary length.

DETAILED DESCRIPTION

The invention will now be described in detail and illustrated by examples without introducing limitations.

Hereinafter, Ms designates the martensite start temperature, i.e. the temperature at which the austenite begins to transform into martensite upon cooling. These temperatures can be calculated from a formula:

$$Ms=560-(30*\%\ Mn+13*\%\ Si-15*\%\ Al+12*\%\ Mo)-600*(1-\exp(-0.96*C))$$

The composition of the steel according to the invention will now be described, the content being expressed in weight percent.

According to the invention the carbon content is between 0.1% and 0.25%. Above 0.25% of carbon, weldability of the steel sheet may be reduced. If the carbon content is lower than 0.1%, the austenite fraction is not stabilized enough to obtain, after annealing, the targeted microstructure. In a preferred embodiment of the invention, the carbon content is between 0.15% and 0.20%.

The manganese content is comprised between 3.00% and 5.00%. Above 5.00% of addition, the risk of central segregation increases to the detriment of the toughness. The minimum is defined to stabilize austenite, to obtain, after annealing, the targeted microstructure. Preferably, the manganese content is between 3.50% and 5.00%. In a preferred embodiment of the invention, the manganese content is between 3.50% and 4.50%.

According to the invention, the silicon content is comprised between 0.80% and 1.60%. Above 1.60%, silicon is detrimental for toughness. Moreover, silicon oxides form at the surface, which impairs the coatability of the steel. A silicon addition of at least 0.80% helps to stabilize a sufficient amount of austenite to obtain, after annealing, the microstructure according to the invention. In a preferred embodiment of the invention, the silicon content is between 1.00% and 1.60%.

According to the invention, the boron content is comprised between 0.0003% and 0.004%. The presence of boron delays bainitic transformation to a lower temperature and the bainite formed at low temperature has a lath morphology which increases the toughness. Above 0.004%, the formation of borocarbides at the prior austenite grain boundaries is promoted, making the steel more brittle. Below 0.0003%, there is not a sufficient concentration of free B that segregates at the prior austenite grain boundaries to increase toughness of the steel. In a preferred embodiment of the invention, the boron content is between 0.001% and 0.003%.

Optionally some elements can be added to the composition of the steel according to the invention.

Titanium can be added up to 0.04% to provide precipitation strengthening. Preferably, a minimum of 0.01% of titanium is added in addition of boron to protect boron against the formation of BN.

Niobium can optionally be added up to 0.05% to refine the austenite grains during hot-rolling and to provide precipitation strengthening. Preferably, the minimum amount of niobium added is 0.0010%.

Molybdenum can optionally be added up to 0.3% in order to decrease the phosphorus segregation. Above 0.3%, the addition of molybdenum is costly and ineffective in view of the properties which are required.

Aluminium is a very effective element for deoxidizing the steel in the liquid phase during elaboration. The aluminium content can be added up to 0.90% maximum, to avoid the occurrence of inclusions and to avoid oxidation problems.

A maximum of 0.80% of chromium is allowed, above a saturation effect is noted, and adding chromium is both useless and expensive.

The remainder of the composition of the steel is iron and impurities resulting from the smelting. In this respect, P, S and N at least are considered as residual elements which are unavoidable impurities. Their content is less than 0.010% for S, less than 0.020% for P and less than 0.008% for N. In particular phosphorus segregates at grain boundary and for a phosphorus content higher than 0.020%, the toughness of the steel is reduced.

The microstructure of the hot rolled and annealed steel sheet according to the invention will now be described.

The hot rolled and annealed steel sheet has a microstructure consisting of, in surface fraction, 20% or more of recrystallized ferrite, the balance being non-recrystallized ferrite (including 0%), 15% or more of said recrystallized ferrite having grain size larger than 5 μm, and a density of carbides at grain boundary of recrystallized ferrite less than or equal to 5 carbides per 10 μm of grain boundary length.

Recrystallized ferrite corresponds to grains of ferrite which recrystallized during hot band annealing. During hot rolling, austenite grains are being elongated, and present a so-called pancake shape. Hot rolling generates dislocations, which stored energy. During annealing, such stored energy is a driving force for forming grains of ferrite, with a very low dislocation density inside the grain. As the recrystallization progresses, the hardness of the steel decreases. Below 20% of recrystallized ferrite, targeted properties are not reached. In a preferred embodiment of the invention, said recrystallized ferrite is between 40% and 60%. In another preferred embodiment of the invention, said recrystallized ferrite is between 80% and 100%.

15% or more of recrystallized ferrite presents a grain size larger than 5 μm, in order to reach low hardness level.

Recrystallized ferrite can be distinguished from non-recrystallized ferrite thanks to its morphology which is equiaxed form. Recrystallized ferrite observed with BSE (Back Scattered Electron) mode in SEM (Scanning Electron Microscope) presents a homogeneous contrast, thanks to the low dislocation density.

The balance of the microstructure is non-recrystallized ferrite, which is comprised between 0% (including) and 80%. The part of bainite and martensite which cannot be recrystallized during hot band annealing is the portion of non-recrystallized ferrite.

The density of carbides at grain boundary of recrystallized ferrite is less than or equal to 5 carbides per 10 μm of grain boundary length to improve toughness of the steel.

The hot rolled and annealed steel sheet according to the invention has Charpy impact energy E at 20° C. higher than 0.40 J/mm$^2$ measured according to Standard ISO 148-1: 2006 (F) and ISO 148-1:2017(F).

The hot rolled and annealed steel sheet according to the invention has a Vickers hardness level lower than 300 HV.

The steel sheet according to the invention can be produced by any appropriate manufacturing method and the man skilled in the art can define one. It is however preferred to use the method according to the invention comprising the following steps:

A semi-finished product able to be further hot-rolled is provided with the steel composition described above. The semi-finished product is heated to a temperature comprised between 1150° C. and 1300° C., so to make it possible to ease hot rolling, with a final hot rolling temperature FRT depending of the chemical composition of the steel.

To obtain targeted properties, a skilled person must select a finish rolling temperature FRT promoting recrystallisation of the matrix after hot band annealing. Beyond a certain value of FRT that directly depends on the chemical composition of the steel, stored energy is no longer sufficient to recrystallize ferrite after hot band annealing. Preferably, the FRT is comprised between 750° C. and 1000° C. More preferably, the FRT is comprised between 800° C. and 950° C.

The hot-rolled steel is then cooled and coiled at a temperature $T_{coil}$ comprised between 20° C. and 550° C. Preferably, the $T_{coil}$ temperature is comprised from (Ms−100° C.) to 550° C.

After the coiling, the sheet can be pickled to remove oxidation.

The coiled steel sheet is then annealed to an annealing temperature Ta that is below Ac1. The steel sheet is maintained at said temperature Ta for a holding time to comprised between 0.1 and 100h in order to decrease the hardness while maintaining the toughness above 0.4 J/mm$^2$ of the hot-rolled steel sheet. To obtain targeted properties, a skilled person must select Ta to favor recrystallization of ferrite. Annealing at too low a temperature limits recrystallization of ferrite and promotes carbides at grain boundaries, decreasing toughness of the steel sheet. Preferably Ta is comprised between 500° C. and Ac1.

After hot band annealing, the density of carbides at grain boundary is less than 5 carbides per 10 μm of grain boundary length, improving toughness of the steel. The hot rolled and annealed steel sheet is then cooled to room temperature.

The hot rolled and annealed steel sheet has good properties of toughness and hardness making further process possible. For example, the hot rolled and annealed steel sheet can then be cold rolled to obtain a cold rolled steel sheet having a thickness that can be, for example, between 0.7 mm and 3 mm, or even better in the range of 0.8 mm to 2 mm. The cold-rolling reduction ratio is preferably comprised between 20% and 80%.

The invention will be now illustrated by the following examples, which are by no way limiting.

Example 1

3 grades, whose compositions are gathered in table 1, were cast in semi-finished products and processed into steel sheets following the process parameters gathered in table 2.

TABLE 1

Compositions
The tested compositions are gathered in the following table wherein the element contents are expressed in weight percent.

| Steel | C | Mn | Si | B | S | P | N | Ti | Mo | Al | Ac1 (° C.) | Ms (° C.) |
|---|---|---|---|---|---|---|---|---|---|---|---|---|
| A | 0.18 | 3.94 | 1.29 | 0.0022 | 0.002 | 0.01 | 0.002 | 0.023 | 0.19 | 0.03 | 640 | 328 |
| B | 0.18 | 3.85 | 1.27 | 0.0024 | 0.002 | 0.01 | 0.003 | 0.026 | 0.21 | 0.6 | 655 | 339 |
| C | 0.18 | 3.96 | 1.48 | 0.0022 | 0.002 | 0.01 | 0.002 | 0.024 | 0.19 | 0.03 | 640 | 325 |

Steels A-C are according to the invention.

Ac1 temperature has been determined through dilatometry tests and metallography analysis.

TABLE 2

Process parameters
Steel semi-products, as cast, were reheated at 1200° C. during 1800 s, hot rolled and then coiled before the hot band annealing. The following specific conditions were applied:

| | | FRT | | Annealing | |
|---|---|---|---|---|---|
| Trial | Steel | (° C.) | $T_{Coil}$ (° C.) | Ta (° C.) | ta (h) |
| 1 | A | 950 | 450 | 620 | 23 |
| 2 | A | 900 | 450 | 620 | 23 |
| 3 | A | 850 | 450 | 620 | 23 |
| 4 | A | 800 | 450 | 620 | 23 |
| 5 | B | 950 | 450 | 620 | 23 |
| 6 | B | 900 | 450 | 620 | 23 |
| 7 | B | 850 | 450 | 620 | 23 |
| 8 | B | 800 | 450 | 620 | 23 |
| 9 | C | 950 | 450 | 620 | 23 |
| 10 | C | 900 | 450 | 620 | 23 |
| 11 | C | 850 | 450 | 620 | 23 |
| 12 | C | 800 | 450 | 620 | 23 |

The hot rolled and annealed sheets were then analyzed and the corresponding microstructure elements and mechanical properties were respectively gathered in table 3 and 4.

TABLE 3

Microstructure of the hot rolled and annealed steel sheet
The phase percentages of the microstructures of the obtained hot rolled and annealed steel sheet were determined:

| Trial | Recrystallized ferrite (%) | Non-recrystallized ferrite (%) | Density of carbides at grain boundary (number/10 μm) | Recrystallized ferrite with size >5 μm (%) |
|---|---|---|---|---|
| 1 | 20 | 80 | 5 | 15 |
| 2 | 40 | 60 | 4 | 30 |
| 3 | 95 | 5 | 2 | 65 |
| 4 | 98 | 2 | 1.5 | 75 |
| 5 | 5 | 95 | 6 | 0 |
| 6 | 10 | 90 | 5 | 1 |
| 7 | 98 | 2 | 2 | 80 |
| 8 | 100 | 0 | 2 | 80 |
| 9 | 5 | 95 | 6 | 0 |
| 10 | 5 | 95 | 5 | 1 |
| 11 | 25 | 75 | 5 | 7 |
| 12 | 80 | 20 | 4 | 40 |

Underlined values: not corresponding to the invention

The surface fractions are determined through the following method: a specimen is cut from the hot rolled and annealed, polished and etched with a reagent known per se, to reveal the microstructure. The section is afterwards examined through scanning electron microscope, for example with a Scanning Electron Microscope with a Field Emission Gun ("FEG-SEM") at a magnification greater than 5000×, in both secondary electron mode and back scattered electron mode.

TABLE 4

Mechanical properties of the hot rolled and annealed steel sheet
Mechanical properties of the tested samples were determined and gathered in the following table:

| Trial | Charpy impact energy ($J/mm^2$) | Hardness (HV) |
|---|---|---|
| 1 | 0.40 | 278 |
| 2 | 0.49 | 263 |
| 3 | 0.69 | 211 |
| 4 | 0.70 | 204 |
| 5 | 0.34 | 285 |
| 6 | 0.30 | 293 |
| 7 | 0.69 | 210 |
| 8 | 0.66 | 214 |
| 9 | 0.31 | 296 |
| 10 | 0.28 | 290 |
| 11 | 0.30 | 269 |
| 12 | 0.44 | 221 |

Underlined values: do not match the targeted values

To obtain targeted properties, a skilled person must select finish rolling temperature FRT in order to favor matrix recrystallization after annealing.

In order to obtain a final hot rolled and annealed steel sheet with more than 20% of recrystallized ferrite, the balance being non-recrystallized ferrite, trials have been carried out with FRT of 800° C., 850° C., 900° C. and 950° C., before being annealed at a temperature Ta of 620° C. during a time to of 23*h*.

In trials 1-4, steel A is hot rolled with a FRT of 950° C., 900° C., 850° C. and 800° C. respectively. These examples show all targeted properties thanks to their specific composition and microstructure.

In Trials 5-8, steel B is hot rolled with FRT of 800° C., 850° C., 900° C. and 950° C.

The high FRT of trials 5 and 6 respectively 950° C. and 900° C., leads to a level of recrystallized ferrite after annealing of 5% and 10%, smaller than the desired level. In trials 7-8, more than 98% of ferrite is recrystallized thanks to the low level of FRT of 850° C. and 800° C.

In trials 9-12, steel C is hot rolled with FRT of 800° C., 850° C., 900° C. and 950° C.

In this case, a FRT higher than 900° C. implies a microstructure out of the invention. For trials 9-11, the density of carbides at grain boundary is higher than the desired level, leading to a low toughness of the steel.

Example 2

1 grade, whose composition is gathered in table 6, was cast in semi-products and processed into steel sheets following the process parameters gathered in table 7.

TABLE 6

| Chemical composition | | | | | | | | | | | | | |
|---|---|---|---|---|---|---|---|---|---|---|---|---|---|
| Steel | C | Mn | Si | B | S | P | N | Ti | Nb | Mo | Al | Ac1 (° C.) | Ms (° C.) |
| D | 0.19 | 3.86 | 1.27 | 0.0021 | 0.001 | 0.01 | 0.003 | 0.029 | 0.02 | 0.20 | 0.39 | 650 | 331 |

Steel D is according to the invention.

TABLE 7

Process parameters
Steel semi-products, as cast, were reheated at 1200° C. during 1800 s, hot rolled and then coiled before a hot band annealing. The following specific conditions were applied:

| | | FRT | | Annealing | |
|---|---|---|---|---|---|
| Trial | Steel | (° C.) | $T_{Coil}$ (° C.) | Ta (° C.) | ta (h) |
| 13 | D | 845 | 300 | 594 | 23 |
| 14 | D | 845 | 300 | 605 | 7 |
| 15 | D | 845 | 300 | 619 | 7 |
| 16 | D | 845 | 300 | 633 | 7 |
| 17 | D | 845 | 300 | 648 | 7 |

The hot rolled and annealed sheets were then analyzed, and the corresponding microstructure elements and mechanical property were respectively gathered in table 8 and 9.

TABLE 8

Microstructure of the hot rolled and annealed steel sheet
The phase percentages of the microstructures of the obtained hot rolled and annealed steel sheet were determined:

| Trial | Recrystallized ferrite (%) | Non-recrystallized ferrite (%) | Density of carbides at grain boundary (number/10 μm) | Recrystallized ferrite with size >5 μm (%) |
|---|---|---|---|---|
| 13 | 5 | 95 | 10 | 0 |
| 14 | 30 | 70 | 6 | 7 |
| 15 | 45 | 55 | 3 | 40 |
| 16 | 55 | 45 | 2 | 48 |
| 17 | 60 | 40 | 1.5 | 50 |

Underlined values: not corresponding to the invention

The surface fractions are determined through the following method: a specimen is cut from the hot rolled and annealed, polished and etched with a reagent known per se, to reveal the microstructure. The section is afterwards examined through scanning electron microscope, for example with a Scanning Electron Microscope with a Field Emission Gun ("FEG-SEM") at a magnification greater than 5000×, in both secondary electron mode and back scattered electron mode.

TABLE 9

Mechanical properties of the hot rolled and annealed steel sheet
Mechanical properties of the tested samples were determined and gathered in the following table:

| Trial | Charpy impact energy ($J/mm^2$) | Hardness (HV) |
|---|---|---|
| 13 | 0.20 | 324 |
| 14 | 0.26 | 300 |
| 15 | 0.41 | 271 |

TABLE 9-continued

Mechanical properties of the hot rolled and annealed steel sheet
Mechanical properties of the tested samples were determined and gathered in the following table:

| Trial | Charpy impact energy ($J/mm^2$) | Hardness (HV) |
|---|---|---|
| 16 | 0.53 | 235 |
| 17 | 0.56 | 223 |

Underlined values: not corresponding to the invention

Trials 13-17 have been performed with a FRT of 845° C. and by varying the annealing temperature Ta, in order to obtain a final annealed steel sheet with more than 20% of recrystallized ferrite, the balance being non-recrystallized ferrite, and to limit carbides at grain boundaries.

If Ta is too low, as in trials 13 and 14, ferrite is not sufficiently recrystallized, and steel is too hard. The high quantity of carbides formed at grain boundary reduce toughness of the steel.

What is claimed is:

1. A hot rolled and annealed steel sheet, made of a steel having a composition comprising, by weight percent:

C: 0.1-0.25%
Mn: 3.00-5.00%
Si: 0.80-1.60%
B: 0.0003-0.004%
S≤0.010%
P≤0.020%
N≤0.008% and optionally one or more of the following elements, in weight percentage:

Ti≤0.04%
Nb≤0.05%
Mo≤0.3%
Al≤0.90%
Cr≤0.80% a remainder of the composition being iron and unavoidable impurities resulting from processing;

the steel sheet having a microstructure including, in surface fraction, 20% or more of recrystallized ferrite, a balance being non-recrystallized ferrite, 15% or more of the recrystallized ferrite having grain size larger than 5 μm, and a density of carbides at a grain boundary of recrystallized ferrite being less than or equal to 5 carbides per 10 μm of grain boundary length.

2. The hot rolled and annealed steel sheet as recited in claim 1 wherein the recrystallized ferrite is between 40% and 60%.

3. The hot rolled and annealed steel sheet as recited in claim 1 wherein the recrystallized ferrite is between 80% and 100%.

4. The hot rolled and annealed steel sheet as recited in claim 1 wherein the manganese content is between 3.50% and 4.50%.

5. The hot rolled and annealed steel sheet as recited in claim 1 wherein the silicon content is between 1.00% and 1.60%.

6. The hot rolled and annealed steel sheet as recited in claim 1 wherein the hot rolled and annealed steel sheet has a Charpy impact energy at 20° C. higher than 0.40 J/mm$^2$, measured according to Standard ISO 148-1:2006 (F) and ISO 148-1:2017 (F).

7. The hot rolled and annealed steel sheet as recited in claim 1 wherein the hot rolled and annealed steel sheet has a hardness level lower than 300 HV.

8. A cold rolled steel sheet obtained from cold rolling of the hot rolled and annealed steel sheet as recited in claim 1.

9. The hot rolled and annealed steel sheet as recited in claim 1 wherein Si: 1.27-1.60%, by weight percent.

10. The hot rolled and annealed steel sheet as recited in claim 1 wherein the microstructure consists of recrystallized ferrite and non-recrystallized ferrite.

11. The hot rolled and annealed steel sheet as recited in claim 1 wherein 30% or more of the recrystallized ferrite having grain size larger than 5 μm.

12. The hot rolled and annealed steel sheet as recited in claim 1 wherein 40% or more of the recrystallized ferrite having grain size larger than 5 μm.

13. The hot rolled and annealed steel sheet as recited in claim 1 wherein 50% or more of the recrystallized ferrite has a grain size larger than 5 μm.

14. The hot rolled and annealed steel sheet as recited in claim 1 wherein 65% or more of the recrystallized ferrite has a grain size larger than 5 μm.

15. The hot rolled and annealed steel sheet as recited in claim 1 wherein 50%-80% of the recrystallized ferrite has a grain size larger than 5 μm.

16. The hot rolled and annealed steel sheet as recited in claim 1 wherein 30%-80% of the recrystallized ferrite has a grain size larger than 5 μm.

17. The hot rolled and annealed steel sheet as recited in claim 1 wherein 40%-80% of the recrystallized ferrite has a grain size larger than 5 μm.

18. A hot rolled and annealed steel sheet, made of a steel having a composition comprising, by weight percent:

C: 0.1-0.25%
Mn: 3.5-5.00%
Si: 0.80-1.60%
B: 0.0003-0.004%
S≤0.010%
P≤0.020%
N≤0.008% and optionally one or more of the following elements, in weight percentage:

Ti≤0.04%
Nb≤0.05%
Mo≤0.3%
Al≤0.90%
Cr≤0.80% a remainder of the composition being iron and unavoidable impurities resulting from processing;

the steel sheet having a microstructure including, in surface fraction, 20% or more of recrystallized ferrite, a balance being non-recrystallized ferrite, 15% or more of the recrystallized ferrite having grain size larger than 5 μm, and a density of carbides at a grain boundary of recrystallized ferrite being less than or equal to 5 carbides per 10 μm of grain boundary length.

19. The hot rolled and annealed steel sheet as recited in claim 18 wherein Si: 1.27-1.60%, by weight percent.

* * * * *